US005537088A

United States Patent [19]

Ikemoto

[11] Patent Number: 5,537,088

[45] Date of Patent: Jul. 16, 1996

[54] STRUCTURE OF AN INDUCTION SENSOR

[75] Inventor: Takeshi Ikemoto, Tokyo, Japan

[73] Assignee: NEC Corporation, Tokyo, Japan

[21] Appl. No.: 330,068

[22] Filed: Oct. 26, 1994

[30] Foreign Application Priority Data

Oct. 26, 1993 [JP] Japan ..... 5-289999

[51] Int. Cl.[6] ..... H01F 21/04; H05B 3/00

[52] U.S. Cl. ..... 336/129; 29/846; 29/464

[58] Field of Search ..... 336/129; 29/846, 29/464

[56] References Cited

U.S. PATENT DOCUMENTS

| | | | |
|---|---|---|---|
| 2,799,835 | 7/1957 | Tripp et al. | 336/129 |
| 3,596,222 | 7/1971 | Pagella | 336/129 |
| 3,953,816 | 4/1976 | Hennequin | 336/129 |
| 4,646,087 | 2/1987 | Schumann | 340/870.31 |
| 5,267,394 | 12/1993 | Amano et al. | 29/611 |

FOREIGN PATENT DOCUMENTS 60-230881 11/1985 Japan .

*Primary Examiner*—Leo P. Picard
*Assistant Examiner*—G. R. Lord
*Attorney, Agent, or Firm*—Sughrue, Mion, Zinn, Macpeak & Seas

[57] ABSTRACT

In an induction sensor, a plurality of positioning holes are formed through each of a scaler and a slider. The positioning holes of the scaler and slider are spaced the same distance from respective coils and are of the same size and arranged at the same interval. The gap length and azimuth angle between the scaler and the slider are maintained with accuracy.

10 Claims, 1 Drawing Sheet

STRUCTURE OF AN INDUCTION SENSOR

BACKGROUND OF THE INVENTION

The present invention relates to an induction sensor for sensing the displacement of a movable body by electromagnetic induction and, more particularly, to an induction sensor having a unique structure.

An induction sensor has customarily been used to sense the displacement of a movable body, e.g., a carriage included in a printer and movable in the right-and-left direction in a reciprocating motion. This kind of sensor has a scaler and a slider each being implemented by a substrate carrying a flat coil on one major stirface thereof. To sense a displacement by electromagnetic induction, the scaler and slider are positioned such that their surfaces carrying the coils thereon face each other. Specifically, the scaler, or sensor body, is affixed to the printer or similar apparatus while the slider is affixed to the carriage or similar movable body whose displacement should be sensed. As an AC current is caused to flow through the coil of the scaler, a displacement is determined in terms of the restilting voltage induced in the coil of the slider.

The prerequisite with the induction sensor is that the scaler and the slider be respectively mounted to the apparatus and the movable body at an accurate distance from each other (referred to as a gap length hereinafter) and at an accurate angle to each other (referred to as an azimuth angle hereinafter). However, it is extremely difficult and time consuming to mount the scaler and slider with such accuracy by hand.

In light of the above, Japanese Patent Laid-Open Publication No. 60-230881 discloses an induction sensor in which a scaler and a slider are movable relative to each other in order to change the gap length therebetween. With such an induction sensor, it is possible to adjust the gap length after mounting the scaler and slider to the apparatus and movable body and, therefore, to enhance the accuracy of the sensor. However, even this kind of scheme cannot allow the azimuth angle between the scaler and the slider to be adjusted.

SUMMARY OF THE INVENTION

It is, therefore, an object of the present invention to provide an accurate induction sensor which maintains the gap length and azimuth angle between a scaler and a slider accurately.

In accordance with the present invention, an induction sensor for sensing by electromagnetic induction the displacement of a movable body of an apparatus on which it is mounted has a scaler comprising a substrate provided with a first flat coil on one major surface thereof, and a slider comprising a substrate provided with a second flat coil on one major surface thereof. The first coil and second coil face each other. The scaler and slider are each formed with a plurality of positioning holes to be positioned relative to each other when they are respectively mounted to the apparatus and the movable body.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 1:
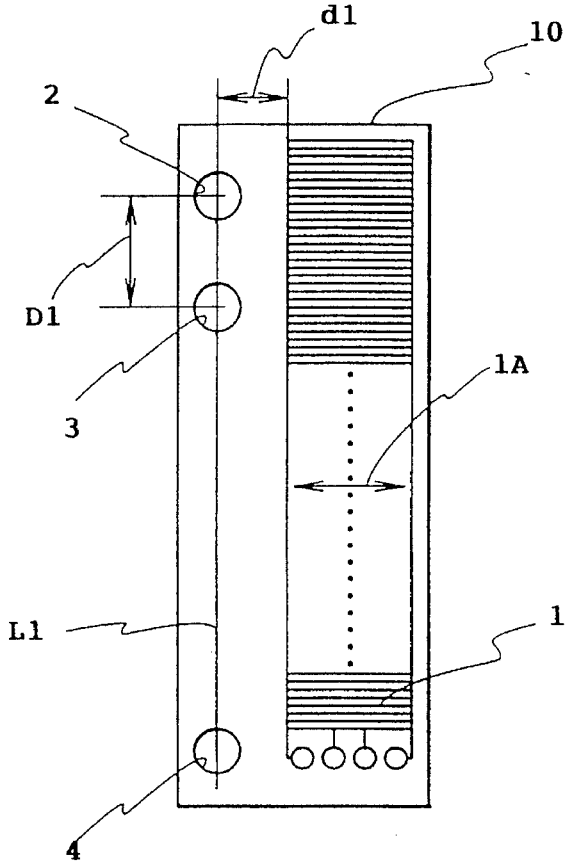
FIG. 1 is a plan view of a scaler included in an induction sensor embodying the present invention.
Figure 2:
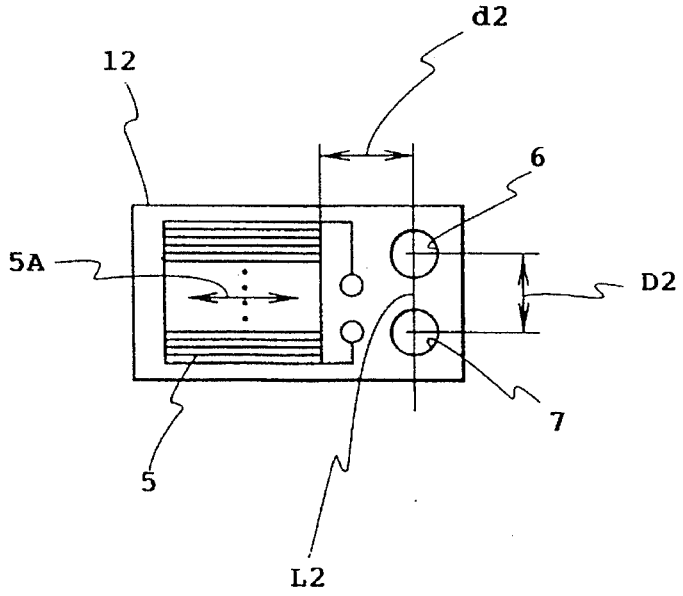
FIG. 2 is a plan view of a slider also included in the embodiment.

Referring to FIGS. 1 and 2, an induction sensor embodying the present invention is shown and made up of a scaler 10 and a slider 12. The scaler 10 and slider 12 are implemented by substrates respectively carrying fiat coils 1 and 5 on one major surface thereof. The scaler 10 and slider 12 are positioned such that their surfaces carrying the coils 1 and 5 thereon face each other. The sensor senses, based on electromagnetic induction, the displacement of a movable body included in a desired apparatus, e.g., a carriage included in a printer. Specifically, the scaler 10 and slider 12 are each comprised of a substrate made of ceramic, resin or similar insulative material. The coils 1 and 5 are implemented by metal foil and formed on such substrates by etching or similar technology.

Holes 2, 3 and 4 are formed through the scaler 10 while holes 6 and 7 are formed through the slider 12. The centers of the holes 2, 3 and 4 are spaced a distance d1 from the coil 1. A line L1, connecting the centers of the holes 2, 3 and 4, is straight and perpendicular mainly to a direction 1A in which a current flows through the coil 1. Likewise, the centers of the holes 6 and 7 formed through the slider 12 are spaced a distance d2, which is equal to the distance d1, from the coil 5. A straight line 1,2, connecting the centers of the holes 6 and 7, is perpendicular mainly to a direction 5A in which a current flows through the coil 5. The distance D1 between the centers of the holes 2 and 3 of the scaler 10 is equal to the distance D2 between the holes 6 and 7 of the slider 12. In addition, the holes 2, 3, 6 and 7 have the same diameter.

The printer or similar apparatus to which the sensor is to be mounted is formed with lugs exactly matching the holes 2, 3 and 4 of the scaler 10. These lugs are positioned such that a straight line connecting them is parallel to a direction in which the movable body, i.e., carriage runs. Such a configuration allows the scaler 10 to be mounted to the printer in the same position at all times. Further, the scaler 10 may be located such that mainly the direction A1 in which a current flows through the coil 1 is perpendicular to a direction in which the displacement of the carriage should be sensed.

The slider 12 is mounted to the carriage, or movable body, such that the holes 2 and 3 of the scaler 10 and the holes 6 and 7 of the slider 12 respectively align with each other. When the slider 12 is mounted to the carriage in this condition, the azimuth angle between the scaler 10 and the slider 12 is precisely zero degree. Therefore, the sensor can sense the displacement of the carriage with accuracy.

To maintain the holes 2 and 6 and the holes 3 and 7 in alignment, cylindrical lugs may be passed through the holes 2, 3, 6 and 7.

In summary, it will be seen that the present invention provides an induction sensor having a scaler and a slider which can be accurately mounted to a desired apparatus and a movable body thereof, respectively. This unprecedented advantage is derived from a plurality of positioning holes formed through each of the scaler and slider. Furthermore, the positioning holes of the scaler and slider are spaced the same distance from the respective coils, and all the positioning holes are of the same size and arranged at the same interval. Hence, the scaler and slider are accurately positioned relative to each other with the holes thereof held in alignment, so that the azimuth angle is precisely zero degree. This allows the sensor to sense the displacement of the movable body with accuracy.

Various modifications will become possible for those skilled in the art after receiving the teachings of the present disclosure without departing from the scope thereof.

What is claimed is:

1. An induction sensor for sensing by electromagnetic induction a displacement of a movable body of an apparatus on which said induction sensor is mounted, said induction sensor comprising:

a scaler comprising a substrate provided with a first flat coil on one major surface thereof; and a slider comprising a substrate provided with a second flat coil on one major surface thereof, said first coil and said second coil facing each other;

said scaler and said slider being each formed with a plurality of positioning holes to be positioned relative to each other when said scaler and said slider are mounted to said apparatus and said movable body, respectively, such that a center of at least one of the positioning holes of said scaler is spaced a first distance from said first flat coil and a center of at least one of the positioning holes of said slider is spaced a second distance from said second flat coil, and wherein said first and second distances are equal.

2. An induction sensor as claimed in claim 1, wherein said plurality of positioning holes of said scaler and said slider are of a same size.

3. An induction sensor as claimed in claim 1, wherein said substrates of said scaler and said slider each comprises an insulative substrate made of resin, and said first coil and said second coil each comprises metal foil formed by etching.

4. An induction sensor as claimed in claim 1, wherein each of the positioning holes of said scaler is spaced from said first flat coil by the first distance.

5. An induction sensor as claimed in claim 1, wherein each of the positioning holes of said slider is spaced from the second flat coil by the second distance.

6. An induction sensor as claimed in claim 4, wherein each of the positioning holes of said slider is spaced from the second flat coil by the second distance.

7. An induction sensor as defined in claim 1, wherein each of the positioning holes of said scaler is arranged at a same first interval.

8. An inductions sensor as claimed in claim 1, wherein each of the positioning holes of said slider is arranged at a same second interval.

9. An induction sensor as claimed in claim 7, wherein each of the positioning holes of said slider is arranged at a same second interval.

10. The induction sensor as claimed in claim 9, wherein said first interval is equal to said second interval.

* * * * *

UNITED STATES PATENT AND TRADEMARK OFFICE

CERTIFICATE OF CORRECTION

PATENT NO. : 5,537,088
DATED : July 16, 1996
INVENTOR(S) : Takeshi IKEMOTO

It is certified that error(s) appears in the above-identified patent and that said Letters Patent is hereby corrected as shown below:

Col. 2, line 29, delete "1, 2" and insert --L2--.

Signed and Sealed this

Seventeenth Day of December, 1996

*Attest:*

*Attesting Officer*

BRUCE LEHMAN

*Commissioner of Patents and Trademarks*